US011547254B2

(12) United States Patent
Bagwell

(10) Patent No.: US 11,547,254 B2
(45) Date of Patent: Jan. 10, 2023

(54) VACUUM CLEANING APPARATUS

(71) Applicant: Infinite Appliances Ltd, Warwickshire (GB)

(72) Inventor: Martin Paul Bagwell, Warwickshire (GB)

(73) Assignee: Infinite Appliances Ltd

( * ) Notice: Subject to any disclaimer, the term of this patent is extended or adjusted under 35 U.S.C. 154(b) by 0 days.

(21) Appl. No.: 16/980,038

(22) PCT Filed: Mar. 12, 2019

(86) PCT No.: PCT/GB2019/050681
§ 371 (c)(1),
(2) Date: Sep. 11, 2020

(87) PCT Pub. No.: WO2019/175561
PCT Pub. Date: Sep. 19, 2019

(65) Prior Publication Data

US 2021/0007563 A1 Jan. 14, 2021

(30) Foreign Application Priority Data

Mar. 14, 2018 (GB) ..... 1804071

(51) Int. Cl.
*A47L 5/24* (2006.01)
*A47L 5/22* (2006.01)
(Continued)

(52) U.S. Cl.
CPC ..... *A47L 5/24* (2013.01); *A47L 5/225* (2013.01); *A47L 9/0072* (2013.01);
(Continued)

(58) Field of Classification Search
None
See application file for complete search history.

(56) References Cited

U.S. PATENT DOCUMENTS 3,695,006 A 10/1972 Valbona et al.
3,766,595 A 10/1973 Valbona et al.
(Continued)

FOREIGN PATENT DOCUMENTS

GB 12025 A 12/1912
GB 430785 A 6/1935
(Continued)

OTHER PUBLICATIONS

Search Report from GB Intellectual Property Office in GB1804071.7 dated Oct. 18, 2018.
(Continued)

*Primary Examiner* — Natasha N Campbell
*Assistant Examiner* — Pradhuman Parihar
(74) *Attorney, Agent, or Firm* — Keusey & Associates, P.C.

(57) ABSTRACT

Hand held vacuum cleaning apparatus (100) includes an elongate housing (122) which is cylindrical in shape. The housing (122) defines an inlet opening (108), an interior (124) and an exhaust opening (118). The housing (122) further defines, within the interior (124), a receptacle receiving chamber (112) in which, in use, a removable dust retaining receptacle (115) is located. The receptacle receiving chamber (112) is substantially circular in cross section and comprises substantially the whole of the diameter of the interior (124) in cross section. The apparatus (100) includes a flow inducer (117) located in the interior (124). In use, the flow inducer (117) induces air flow from the inlet opening (108), through the receptacle (115) in the chamber (112), through the flow inducer (117) to the exhaust opening (118).

12 Claims, 5 Drawing Sheets

(51) Int. Cl.

| | |
|---|---|
| ***A47L 9/00*** | (2006.01) |
| ***A47L 9/14*** | (2006.01) |
| ***A47L 9/28*** | (2006.01) |
| ***A47L 9/32*** | (2006.01) |

(52) U.S. Cl.
CPC ..... *A47L 9/1427* (2013.01); *A47L 9/2884* (2013.01); *A47L 9/322* (2013.01)

(56) References Cited

U.S. PATENT DOCUMENTS

| | | | | |
|---|---|---|---|---|
| 3,966,444 | A | 6/1976 | Clowers et al. | |
| 4,959,885 | A * | 10/1990 | Sovis | A47L 5/34 15/335 |
| 6,122,796 | A * | 9/2000 | Downham | A47L 5/00 15/328 |
| 7,404,230 | B1 | 7/2008 | Phillips | |
| 2002/0092123 | A1 | 7/2002 | Stephens | |
| 2007/0163075 | A1* | 7/2007 | Butler | A47L 9/04 15/350 |
| 2008/0040883 | A1* | 2/2008 | Beskow | A47L 9/165 15/329 |
| 2010/0251506 | A1 | 10/2010 | Conrad | |
| 2017/0079489 | A1* | 3/2017 | Dimbylow | A47L 9/00 |
| 2017/0209014 | A1* | 7/2017 | Stickney | A47L 5/225 |

FOREIGN PATENT DOCUMENTS

| | | | |
|---|---|---|---|
| GB | 831352 | A | 3/1960 |
| GB | 992716 | A | 5/1965 |
| GB | 2233218 | A | 9/1991 |
| GB | 2331006 | A | 12/1999 |
| GB | 2469313 | A | 10/2010 |
| GB | 2542385 | A | 3/2017 |
| JP | H04364822 | A | 12/1992 |
| JP | 2013070853 | A | 4/2013 |
| JP | 2017029409 | A | 2/2017 |
| WO | 2014001489 | A | 1/2014 |

OTHER PUBLICATIONS

First Examination Report from GB Intellectual Property Office in GB1804071.7 dated Apr. 26, 2019.

Applicant's Response to First Examination Report from GB Intellectual Property Office in GB1804071.7 dated Aug. 26, 2019.

Second Examination Report from GB Intellectual Property Office in GB1804071.7 dated Sep. 16, 2019.

Applicant's Response to Second Examination Report from GB Intellectual Property Office in GB1804071.7 dated Nov. 18, 2019.

International Search Report and Written Opinion from European Patent Office in PCT/GB2019/050681 dated Jul. 1, 2019.

* cited by examiner

VACUUM CLEANING APPARATUS

TECHNICAL FIELD

The present invention relates to vacuum cleaning apparatus.

BACKGROUND

The vacuum cleaner market over the last few years has rapidly shifted to cordless vacuums. In particular, stick type vacuum cleaners, also sometimes known as "pole vacuum cleaners" have become popular due to their convenience of use. These vacuum cleaners are typically lighter in weight than traditional upright cleaners and are cordless, being powered by a rechargeable battery. The lighter weight and lack of power lead improves ease and flexibility of use over corded traditional upright cleaners. A householder will often buy one of these vacuum cleaners in addition to a traditional heavier corded vacuum cleaner for localised use, for example in upstairs bedrooms, to avoid the task of carrying the heavier corded vacuum cleaner upstairs.

Conventionally, a stick type vacuum cleaner includes a stick extension tube (also known as a pole or wand) that transfers suction and possibly power to a powered or passive floor cleaning tool, known as a "floor-tool". Stick type vacuum cleaners are predominantly bag-less, i.e. they use a cyclone or similar filter system to separate dust from air before collecting the dust and expelling the air. However, size and weight constraints on the filter system in particular mean that bag-less stick type cleaners are relative less efficient than the heavier and larger conventional bag-less vacuum cleaners.

STATEMENTS OF INVENTION

According to a first aspect of the present invention, there is provided vacuum cleaning apparatus, the apparatus including an elongate housing; the housing defining an inlet opening, an interior and an exhaust opening; the housing further defining, within the interior, a receptacle receiving chamber in which, in use, a removable dust retaining receptacle is located, the apparatus including a flow inducer located in the interior, whereby, in use, the flow inducer induces air flow from the inlet opening, through the receptacle in the chamber, through the flow inducer to the exhaust opening.

Possibly, the housing has a longitudinal axis. Possibly, each of the inlet opening, the receptacle, the chamber and the flow inducer is aligned along or in parallel to the longitudinal axis.

Possibly, the housing is cylindrical in shape.

Possibly, the inlet opening is circular, and may be centred on the longitudinal axis.

Possibly, the receptacle is removable from the interior. Possibly, the receptacle is air permeable, and may be formed of an air permeable material. Possibly, the receptacle comprises a dust bag.

Possibly, the receptacle is located in the receptacle chamber.

Possibly, the receptacle chamber is substantially circular in cross section and may comprise substantially the whole of the diameter of the interior in cross section.

Possibly, the flow inducer is located offset from and parallel to the longitudinal axis.

Possibly, the apparatus includes a power store, which may comprise a battery, possibly a rechargeable battery. Possibly, the power store is located so that its longest axis extends in parallel to the longitudinal axis. Possibly, the power store is located alongside the flow inducer.

Possibly, the apparatus includes a handle, which may extend outwardly from the housing and may extend outwardly from the end of the housing remote to the inlet opening. Possibly the handle includes a gripping part, which in use is gripped by a user. Possibly the gripping part has a length, with a longitudinal axis which extends at an angle to the housing longitudinal axis. Possibly, the angle is at least 45° and may be at least 67.5°. Possibly, the angle is no more than 90°. Possibly, the gripping part is arranged so that some part of the length extends on either side of the housing longitudinal axis.

Possibly, the flow inducer includes a motor and a fan. The motor may be a brushless DC motor.

Possibly, the apparatus includes an air cleaning filter located in air flow sequence between the receptacle and the flow inducer. Possibly, the apparatus includes an air cleaning filter located in air flow sequence after the flow inducer.

Possibly, the apparatus is a handheld cordless vacuum cleaning apparatus. Possibly, the apparatus is a stick type handheld cordless vacuum cleaning apparatus.

Possibly, the apparatus includes an accessory, which may define an air flow passage. Possibly, the apparatus is movable between an assembled condition and a disassembled condition. Possibly, in the assembled condition, the accessory is attached to the housing and the passage is in airflow communication with the inlet opening. Possibly, in the disassembled condition, the accessory is detached from the housing and the passage is not in air flow communication with the inlet opening.

Possibly, the accessory includes a stick or wand or pole extension tube and may include a floor tool. The extension tube may have a longitudinal axis, which in the assembled condition, may align along the longitudinal axis of the housing.

Possibly, the housing includes a body and a cover. Possibly, the cover is movable between an open and a closed condition. Possibly, in the open condition, the receptacle can be removed from the chamber.

Possibly, the housing, or a part of the housing, is formed of carbon fibre. Possibly the body is formed of carbon fibre.

According to a second aspect of the present invention, there is provided a method of cleaning a surface such as a floor, the method including providing vacuum cleaning apparatus, the apparatus including an elongate housing; the housing defining an inlet opening, an interior and an exhaust opening; the housing further defining, within the interior, a receptacle receiving chamber in which, in use, a removable dust retaining receptacle is located, the apparatus including a flow inducer located in the interior, whereby, in use, the flow inducer induces air flow from the inlet opening, through the receptacle in the chamber, through the flow inducer to the exhaust opening.

Possibly, the apparatus includes any of the features described in any of the preceding statements or following description. Possibly, the method includes any of the steps described in any of the preceding statements or following description.

FIGURES

An embodiment will now be described, by way of example only, and with reference to the accompanying drawings, in which.

Figure 1:
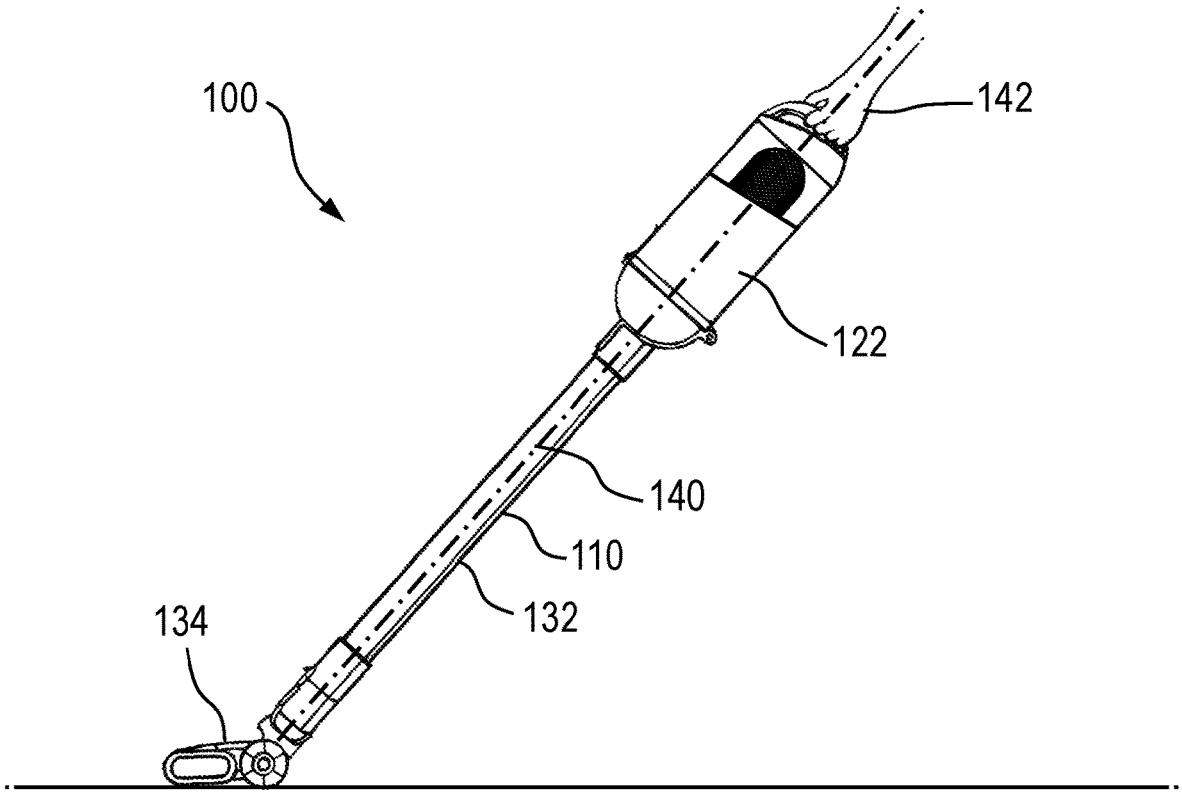
FIG. 1 is a side view of a vacuum cleaning apparatus in an assembled condition with an accessory comprising a stick or wand extension tube and a floor tool.

In the drawings, where multiple instances of the same or similar features exist, only a representative one or some of the instances of the features have been provided with numeric references for clarity.

DESCRIPTION

FIGS. 1 to 5 show vacuum cleaning apparatus 100. The apparatus 100 includes an elongate housing 122. The housing 122 defines an inlet opening 108, an interior 124 and an exhaust opening 118. The housing 122 further defines, within the interior 124, a receptacle receiving chamber 112 in which, in use, a removable dust retaining receptacle 115 is located. The apparatus 100 includes a flow inducer 117 located in the interior 124.

Figure 4:
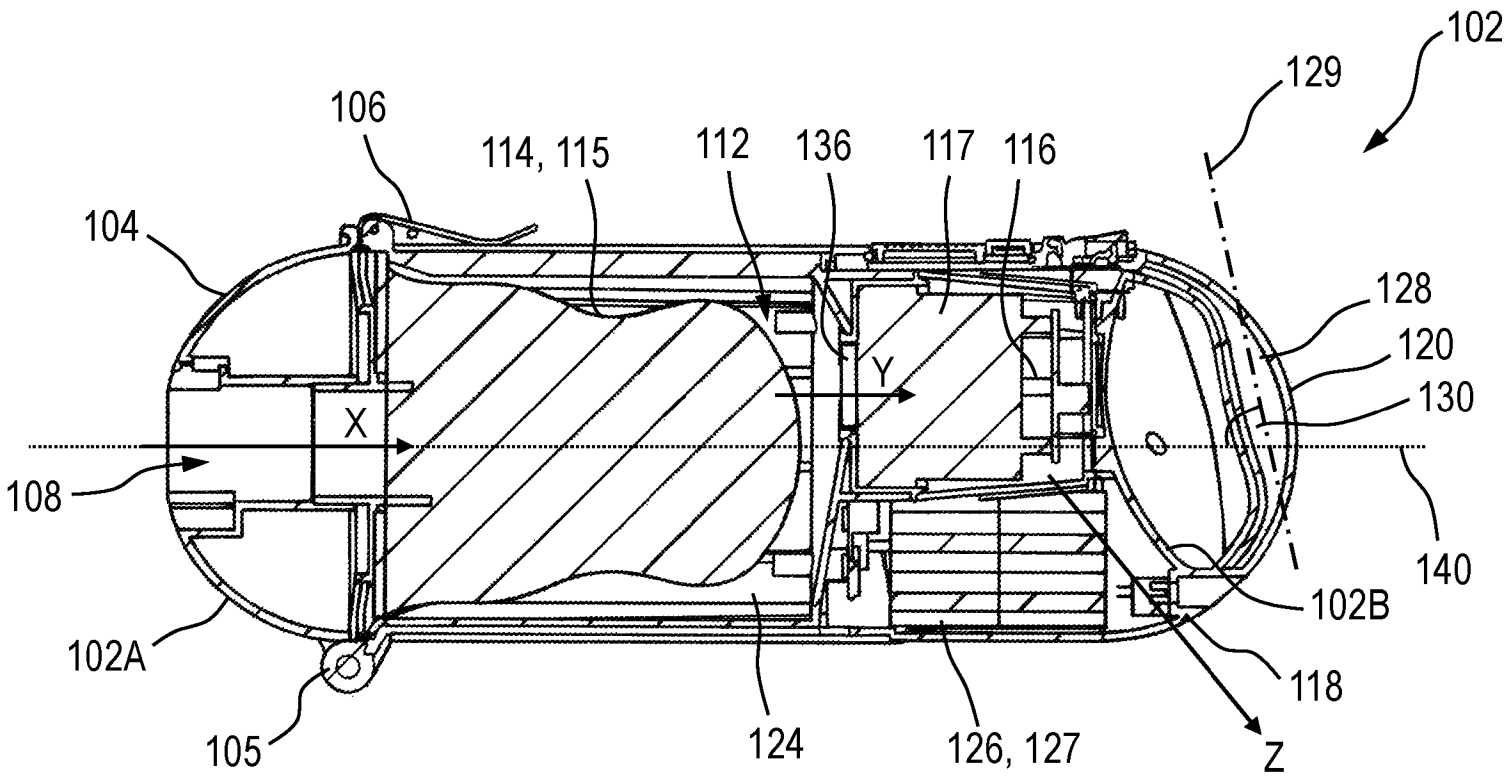
FIG. 4 is a side cross sectional view of the apparatus in the disassembled condition, with a cover in a closed condition.

In use, the flow inducer induces air flow from the inlet opening 108, (arrow X in FIG. 4) through the receptacle 115 in the chamber 112, through the flow inducer 117 (arrow Y in FIG. 4) to the exhaust opening 118 (arrow Z in FIG. 4).

The housing 122 has a longitudinal axis 140. Each of the inlet opening 108, the receptacle 115, the chamber 112 and the flow inducer 117 is aligned along or in parallel to the longitudinal axis.

The housing 122 includes a body 102 and a cover 104. The cover 104 is movably mounted to the body 102 and is movable between an open and a closed condition. In the open condition, the receptacle 115 can be removed from the chamber 112.

The housing 122 is cylindrical in shape, having end parts 102A and 102B. The cover 104 comprises one of the end parts, being a front end part 102A. The other end part, being a rear end part 102B, could be formed integrally as part of the body 102, or formed separately but fixed to the body 102, and possibly removable for maintenance purposes, eg access to the flow inducer 117.

In the example shown, the inlet opening 108 is circular, centred on the longitudinal axis 140.

The receptacle 115 is removable from the interior 124. The receptacle 115 is air permeable, by virtue of being formed of an air permeable material. The receptacle 115 comprises a dust bag 114.

In use, the receptacle 115 is located in the receptacle chamber 112.

The receptacle chamber 112 is substantially circular in cross section and comprises substantially the whole of the diameter of the interior 124 in cross section.

The flow inducer 117 is located slightly offset from and parallel with and close to the longitudinal axis 140. The flow inducer 117 comprises a vacuum pump 116. The vacuum pump 116 comprises a motor, which the Applicant has found beneficially could be a DC brushless motor which in comparison with a conventional brushed motor is relatively small, efficient, low noise and low maintenance. The vacuum pump 116 comprises a fan to induce air flow, the fan being driven by the motor.

The apparatus 100 includes a power store 126, which, in the example shown, comprises a rechargeable battery 127. The power store 126 is located so that its longest axis extends in parallel to the longitudinal axis 140, and the power store 126 is located alongside the flow inducer 117.

The apparatus 100 includes a handle 120, which extends outwardly from the housing 122 from the end of the housing 122 remote to the inlet opening 108. The handle 120 includes a gripping part 128, which in use is gripped by a user. The gripping part 128 has a length, and a longitudinal axis 129 which extends at an angle 130 to the housing longitudinal axis 140. In one example, the angle 130 is at least 45°, and optimally is at least 67.5°, but is no more than 90°.

The gripping part 128 is arranged so that some part of the length extends on either side of the housing longitudinal axis 140. This means that in use, when the gripping part is being gripped by a user and the user's arm (reference numeral 142 in FIG. 1) is extended straight, the user's arm 142, the housing 122 and the stick extension tube 110 can be aligned along the longitudinal axis 140 as shown in FIG. 1. In this configuration, the length of the stick extension tube 110 is minimised, reducing weight for a given length/reach and the user's hand and arm 142 is in an ergonomically correct position.

The apparatus 100 could include an air cleaning inducer filter 136 located in air flow sequence between the chamber 112 and the flow inducer 117. The apparatus 100 could include an exhaust air cleaning filter 138 located in air flow sequence after the flow inducer 117, at or just before the exhaust opening 118.

The apparatus 100 includes an accessory 132, which defines an air flow passage 133. The apparatus 100 is movable between an assembled condition and a disassembled condition. In the assembled condition, the accessory 132 is attached to the housing 122 and the passage 133 is in airflow communication with the inlet opening 108. In the disassembled condition, the accessory 132 is detached from the housing 122 and the passage 133 is not in air flow communication with the inlet opening 108.

Figure 2:
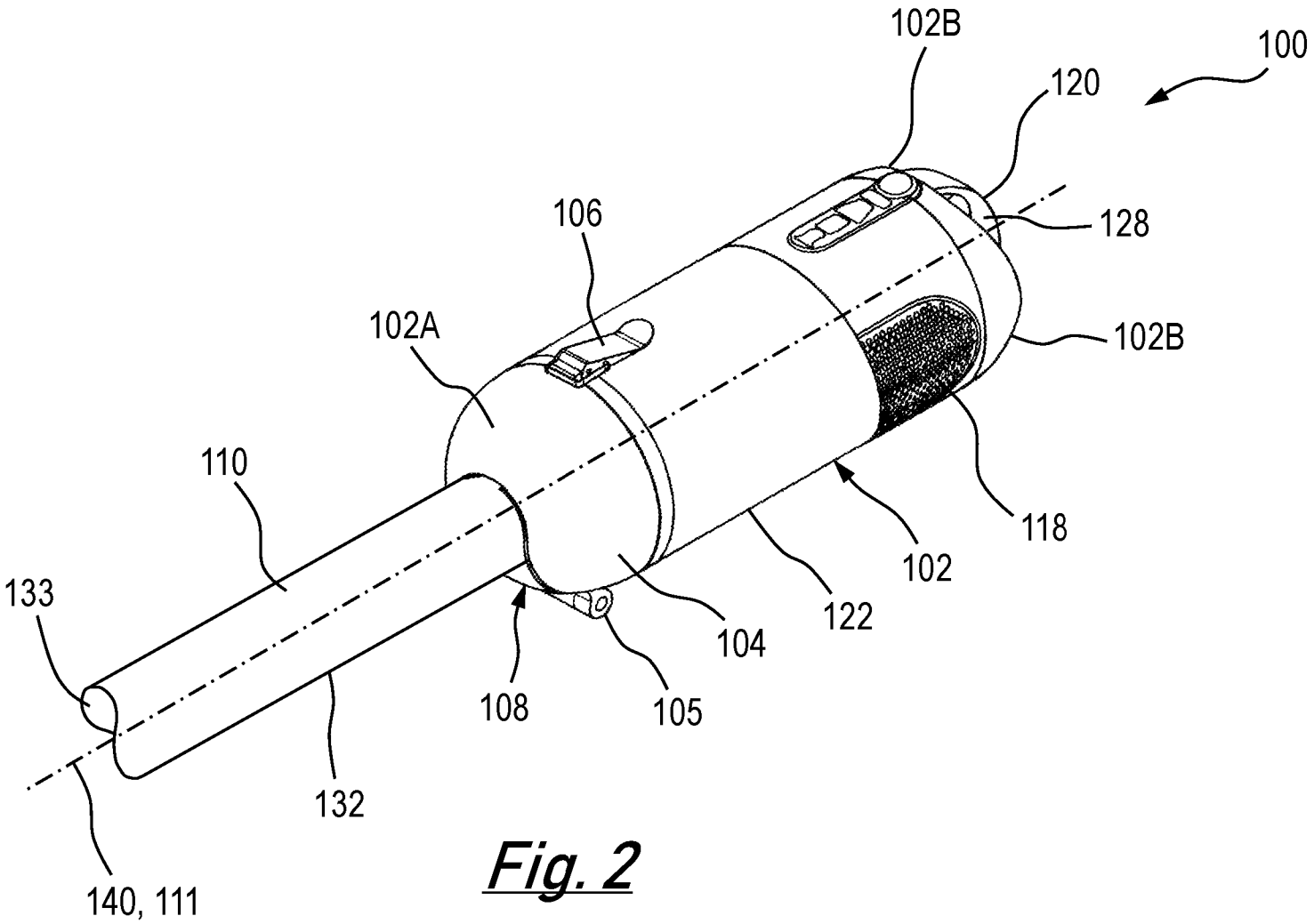
FIG. 2 is a relatively enlarged perspective view of the vacuum cleaning apparatus FIG. 1.
Figure 3:
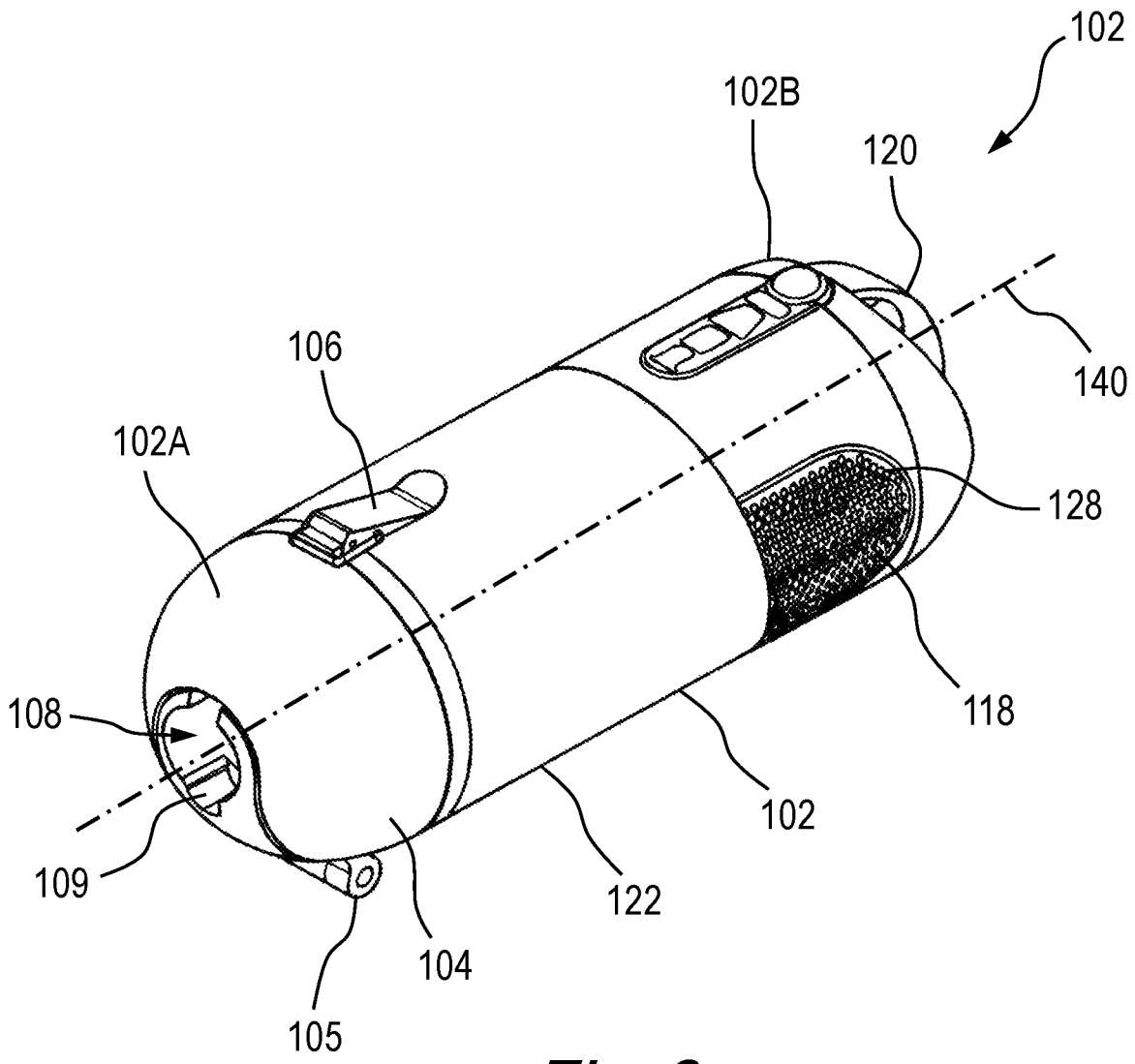
FIG. 3 is a perspective of the apparatus in a disassembled condition.

In one example, as shown in FIGS. 1 and 2, the apparatus 100 is a stick type handheld cordless vacuum cleaning apparatus. The accessory 132 includes a stick (or wand or pole) extension tube 110 and a floor tool 134. The extension tube 110 has a longitudinal axis 111, which in the assembled condition, aligns along the longitudinal axis 140 of the housing 122.

The housing 122 could be made of a hard and light-weight material such as a plastics material so as to prevent breakage thereof in case of an accidental fall on the ground or the like, while minimizing the overall weight of the vacuum cleaning apparatus 100 for better portability and manoeuvrability.

In one example, the body 102 could be made of a hard plastics material, for example, high-density polyethylene (HDPE) or the like.

In one example, the housing 122, or a part of the housing 122, is formed of carbon fibre to provide light weight and high strength. In another example, the body 102 is formed of carbon fibre.

In the closed condition, the cover 104 is sealingly engaged with the body 102. In one example, the cover 104 could be pivotally mounted to the body 102 by a pivot mounting 105.

The cover 104 could be made of the same material as the body 102; however, in other examples, the cover 104 could be made of different materials than the ones used for construction of the body 102 without any limitations. In some examples, the cover 104 may be made of translucent or transparent material, such as, but not limited to, semi-transparent plastics, so that the inside of the body 102 may be visible from the outside.

The apparatus 100 includes a latch 106 so that the cover 104 may be locked against the body 102 so as to prevent any accidental opening of the cover 104, for instance, during operation of the vacuum cleaning apparatus 100. In one example, the latch 106 could be an over centre latch.

In some examples, the apparatus 100 could include engaging formations 109 located at or near the inlet opening 108 for engagement with and securing of the accessory 132.

In the interior 124, the chamber 112 lies adjacent to the inlet opening 108, such that the inlet opening 108 directly opens into the chamber 112 inside the body 102 to be in fluid communication therewith. In the present examples, the chamber 112 is adapted to accommodate a dust bag 114 therein. As may be seen, the dust bag 114 may be attached at its open mouth to the chamber 112 towards the front end part 102A.

Figure 5:
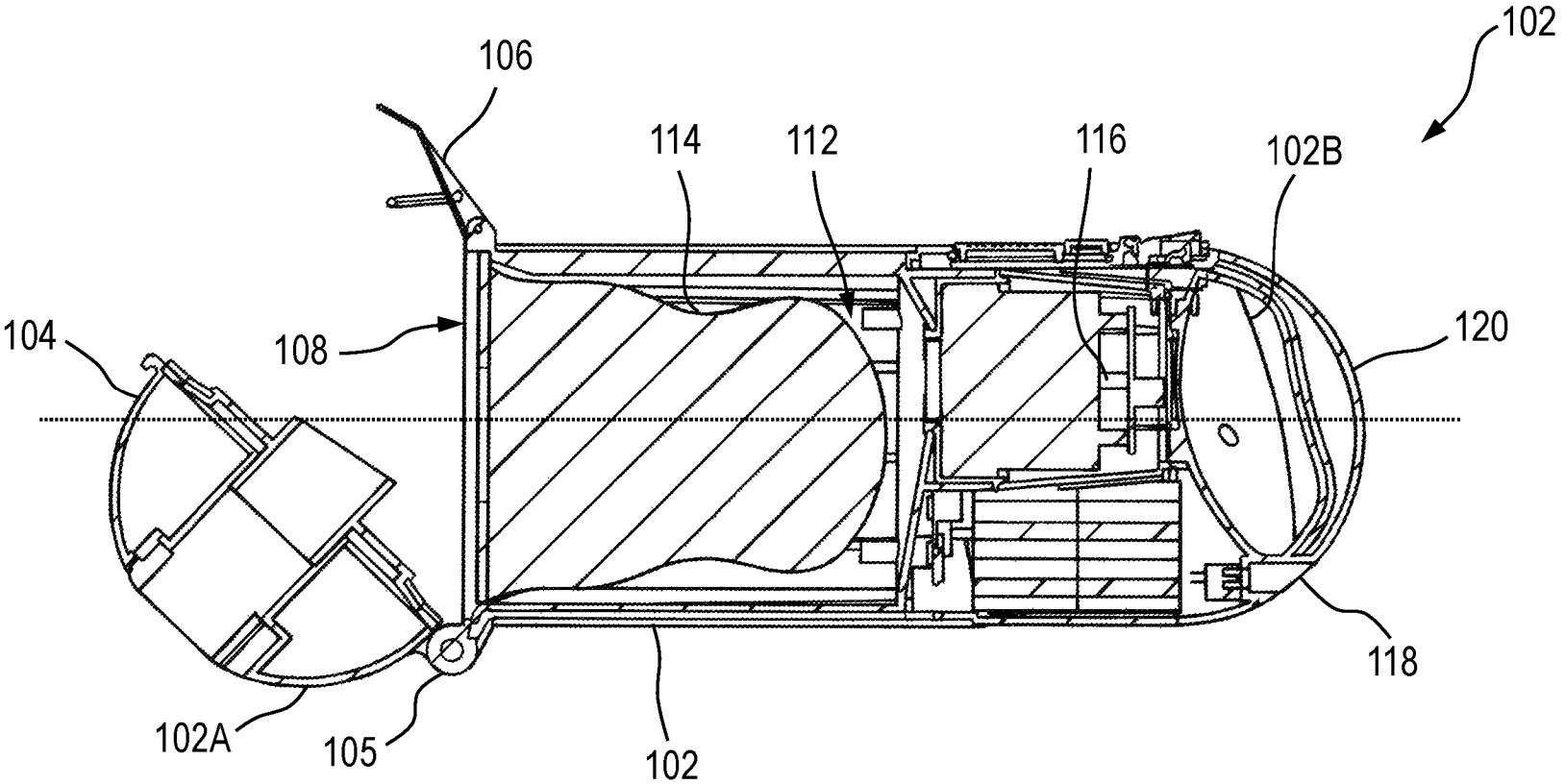
FIG. 5 is a side cross sectional view of the apparatus in the disassembled condition, with the cover in an open condition.

For installing the dust bag 114, the user may open the cover 104 (as shown in FIG. 5) and attach the dust bag 114 to the chamber 112 by suitable connection means, such as, e.g. hooks or clips (not shown). In one or more examples, the dust bag 114 is an air permeable bag which may capture any dirt or debris particles but may allow the air to pass therethrough.

In the interior 124, the vacuum pump 116 may be positioned behind the chamber 112 towards the rear end part 102B. The exhaust opening 118 may be disposed behind the vacuum pump 116 and towards the rear end part 102B.

In use, the vacuum pump 116 is operated and generates a negative pressure inside the chamber 112 and the dust bag 114 which in turn draws air flow through the floor tool 134 through the stick extension tube 110 along the passage 133, through the inlet opening 108 and thereby into the dust bag 114 in the chamber 112. The air flow carries entrained dirt and debris from the cleaning of the floor or the like. The air flow passes through the chamber 112, and specifically the dust bag 114 therein. The dirt and debris particles in the sucked air are trapped by the porous dust bag 114 and the filtered air is expelled by the vacuum pump 116 to the atmosphere, via the exhaust opening 118.

After the cleaning operation, if needed, the dust bag 114 may be removed for washing or replacement thereof by opening the cover 104, and then reinstalled inside the chamber 112.

Advantageously, although smaller and lighter than a conventional vacuum cleaner, the use of the dust bag in the filter system means that there is no loss of efficiency relative to a larger vacuum cleaning appliance, in fact the opposite as will be explained below.

The arrangement of the main components of the apparatus 100 along or parallel with and close to the longitudinal axis 140 provides several advantages. Within the body 102 the air flow is substantially linear, which reduces the pressure drop and increases efficiency. The components are close together to reduce the size and weight of the apparatus 100. The components are close to the handle 120, so that strain on the user's hand and arm 142 is reduced. The components are in line with the stick extension tube 110, reducing the length of the extension tube for a given distance from the user's hand. The heavier components (ie the motor and the battery) are closer to the user's hand, the lighter components (the dust bag) are further away, again reducing the strain due to leverage effect on the user's hand and arm 142.

The use of the brushless DC motor also permits the apparatus to be smaller, lighter and more efficient.

The apparatus 100 could include different types of accessories 132 in addition to the stick extension tube 110, for example, a shorter extension tube for closer work, a cleaning head that fits directly on to the housing etc.

Other Modifications

Various other modifications could be made without departing from the scope of the invention. The apparatus and the various components thereof could be of any suitable size and shape, and could be formed of any suitable material (within the scope of the specific definitions herein).

In some examples, the receptacle 115 could be arranged to be suitable for the collection of wet and dry debris.

There is thus provided vacuum cleaning apparatus with a number of advantages over conventional arrangements.

What is claimed is:

1. A hand held vacuum cleaning apparatus includes an elongate housing extending along a longitudinal axis within a cylindrical shape, the housing defining an inlet opening, an interior and an exhaust opening; the housing further defining, within the interior, a receptacle receiving chamber in which, in use, a removable dust retaining receptacle is located; the receptacle receiving chamber being substantially circular in cross section and comprising substantially the whole of the diameter of the interior in cross section; the apparatus including a flow inducer located in the interior, whereby, in use, the flow inducer induces air flow from the inlet opening, through the removable dust retaining receptacle in the receptacle receiving chamber, through the flow inducer to the exhaust opening, wherein the inlet opening is circular and is centred on the longitudinal axis, each of the inlet opening, the removable dust retaining receptacle and the receptacle receiving chamber is aligned along the longitudinal axis, the flow inducer is aligned in parallel to the longitudinal axis and located offset therefrom, the apparatus includes a power store laterally alongside the flow inducer within the interior of the housing; the apparatus includes a handle, which extends outwardly from an end of the housing remote to the inlet opening, the handle includes a gripping part, which in use is gripped by a user, the gripping part has a length, the gripping part is arranged so that some part of the gripping part length extends on both sides of the housing longitudinal axis and wherein, in sequence along the longitudinal axis, the power store and the flow inducer are both located at the end of the housing and longitudinally aligned with the handle all within the cylindrical shape.

2. The apparatus according to claim 1, in which the gripping part has a longitudinal axis which extends at an angle to the housing longitudinal axis;

and the angle is at least 45° and is no more than 90°.

3. The apparatus according to claim 1, in which the flow inducer includes a motor and a fan, and the motor is a brushless DC motor.

4. The apparatus according to claim 1, in which the apparatus includes an air cleaning filter located in air flow sequence between the removable dust retaining receptacle and the flow inducer.

5. The apparatus according to claim 1, in which the apparatus is a stick type cordless vacuum cleaning apparatus.

6. The apparatus according to claim 1, in which the apparatus includes an accessory, which defines an air flow passage; the apparatus is movable between an assembled condition and a disassembled condition wherein in the assembled condition, the accessory is attached to the housing and the passage is in airflow communication with the inlet opening and in the disassembled condition, the accessory is detached from the housing and the passage is not in air flow communication with the inlet opening and wherein the accessory includes a stick, wand or pole extension tube; and the pole extension tube has a longitudinal axis, which in the assembled condition, aligns along the longitudinal axis of the housing.

7. The apparatus according to claim 1, in which the housing includes a housing body and a cover wherein the cover is movable between an open and a closed condition; and in the open condition, the removable dust retaining receptacle can be removed from the receptacle receiving chamber.

8. The apparatus according to claim 7, in which the housing, or a part of the housing, is formed of carbon fibre.

9. The apparatus according to claim 8, in which the housing body is formed of carbon fibre.

10. The apparatus according to claim 1, in which the removable dust retaining receptacle is air permeable, and is formed of an air permeable material.

11. A hand held vacuum cleaning apparatus includes:

an elongate housing within a cylindrical shape, the housing defining an inlet opening, an interior and an exhaust opening; the housing further defining, within the interior, a receptacle receiving chamber in which, in use, a removable dust retaining receptacle is located; the receptacle receiving chamber being substantially circular in cross section and comprising substantially the whole of the diameter of the interior in cross section; the apparatus including a flow inducer located in the interior, whereby, in use, the flow inducer induces air flow from the inlet opening, through the removable dust retaining receptacle in the receptacle receiving chamber, through the flow inducer to the exhaust opening, wherein the housing has a longitudinal axis, the inlet opening is circular and is centered on the longitudinal axis, each of the inlet opening, the removable dust retaining receptacle, and the receptacle receiving chamber is aligned along the longitudinal axis, the flow inducer is aligned in parallel to the longitudinal axis and located offset therefrom, the apparatus includes a power store, the power store being located within the interior of the cylindrical housing; the apparatus includes a handle, which extends outwardly from an end of the housing remote to the inlet opening, the handle includes a gripping part, which in use is gripped by a user, the gripping part has a length, the gripping part is arranged so that some part of the gripping part length extends on both sides of the housing longitudinal axis;

wherein the power store is located laterally alongside the flow inducer both at the end of the housing and, in sequence along the longitudinal axis, the power store and the flow inducer are longitudinally aligned with the handle all within the cylindrical shape so that the distances between the gripping part, the flow inducer and the power store are minimized.

12. A hand held vacuum cleaning apparatus extending along a central longitudinal axis within a cylindrical shape including an elongate housing having an inlet opening, an interior and an exhaust opening comprising:

the housing containing within the interior:

(i) a receptacle receiving chamber and a removable dust retaining receptacle being substantially circular in cross section and comprising substantially the whole of a diameter of the interior in cross section; (ii) a flow inducer, whereby, in use, the flow inducer induces air flow from the inlet opening, through the removable dust retaining receptacle in the receptacle receiving chamber, through the flow inducer to the exhaust opening, the inlet opening is circular and is centered on the longitudinal axis, wherein each of the inlet opening, the removable dust retaining receptacle, and the receptacle receiving chamber is aligned along the longitudinal axis, the flow inducer is aligned in parallel to the longitudinal axis and located offset therefrom, and (iii) a power store disposed laterally alongside the flow inducer; and a handle which extends outwardly from an end of the housing remote from the inlet opening, the handle includes a gripping part with a length that extends on both sides of the housing central longitudinal axis and is completely within the cylindrical shape, wherein, in sequence, along the longitudinal axis, the power store and the flow inducer are both at the end of the housing and longitudinally aligned with the handle.

* * * * *